US010617908B2

(12) United States Patent
Lin

(10) Patent No.: US 10,617,908 B2
(45) Date of Patent: Apr. 14, 2020

(54) SWINGABLE EXERCISE BIKE

(71) Applicant: BH ASIA LTD., Taichung (TW)

(72) Inventor: Fu Hai Lin, Taichung (TW)

(73) Assignee: BH Asia Ltd., Taichung (TW)

( * ) Notice: Subject to any disclaimer, the term of this patent is extended or adjusted under 35 U.S.C. 154(b) by 0 days.

(21) Appl. No.: 16/113,012

(22) Filed: Aug. 27, 2018

(65) Prior Publication Data

US 2020/0061409 A1 Feb. 27, 2020

(51) Int. Cl.

*A63B 22/06* (2006.01)
*A63B 71/00* (2006.01)
*A63B 21/22* (2006.01)

(52) U.S. Cl.

CPC ..... *A63B 22/0605* (2013.01); *A63B 21/225* (2013.01); *A63B 71/0054* (2013.01); *A63B 2022/0641* (2013.01)

(58) Field of Classification Search

CPC ..... A63B 22/0605; A63B 2022/0641; A63B 22/20–203

See application file for complete search history.

(56) References Cited

U.S. PATENT DOCUMENTS 6,126,577 A * 10/2000 Chang ..... A63B 26/003 434/61
6,322,480 B1 * 11/2001 Lim ..... A63B 26/003 472/103
7,438,672 B1 * 10/2008 Rylander ..... A63B 22/0605 446/396
9,561,418 B1 * 2/2017 Hsiung ..... A63B 21/225
9,861,872 B1 * 1/2018 Hsiung ..... A63B 69/04
9,987,514 B1 * 6/2018 Tung ..... A63B 22/0605
10,039,954 B1 * 8/2018 Tung ..... A63B 22/0605
10,071,298 B1 * 9/2018 McCormack ..... A63B 69/16
2001/0031686 A1 * 10/2001 Ware ..... A63B 21/015 482/57
2002/0077221 A1 * 6/2002 Dalebout ..... A63B 26/003 482/57
2005/0209064 A1 * 9/2005 Peterson ..... A63B 22/16 482/61
2007/0054782 A1 * 3/2007 Lin ..... A63B 21/015 482/57
2008/0020908 A1 * 1/2008 Ibarguren ..... A63B 22/0605 482/57
2009/0203503 A1 * 8/2009 Gothro ..... A63B 22/16 482/72
2010/0288901 A1 * 11/2010 Wallach ..... A63B 22/0076 248/346.03
2015/0111704 A1 * 4/2015 Lin ..... A63B 22/0605 482/57
2015/0238808 A1 * 8/2015 Lin ..... A63B 22/0605 482/57

* cited by examiner

*Primary Examiner* — Jennifer Robertson
(74) *Attorney, Agent, or Firm* — Rosenberg, Klein & Lee

(57) ABSTRACT

A swingable exercise bike includes a base having with a pivot portion for pivoting a bike body to swing left and right relative to the base. Left and right sides of the pivot portion are provided with cushion devices, respectively. The cushion devices are connected to the bike body and provide a horizontal cushioning resistance when the bike body swings left and right, thereby ensuring stable support of the bike body and improving safety in use.

5 Claims, 5 Drawing Sheets

SWINGABLE EXERCISE BIKE

FIELD OF THE INVENTION

The present invention relates to an exercise training device, and more particularly to a swingable exercise bike.

BACKGROUND OF THE INVENTION

According to the trend in sports, people may go to the gym or buy an exercise bike at home for exercise. The bike body of most conventional exercise bikes is stationary, that is, the bike body is fixed to a base. The user stably rides on the bike body and continuously treads to generate a sports effect.

The pedaling action of the exercise bike described above is slightly monotonous, and the user is prone to be inpatient and cannot continue to exercise. Therefore, another exercise bike has been developed on the market. As shown in FIG. 5, a bike body 31 is pivotally connected to a pivot portion 32 of a base 3, allowing the bike body 31 to swing left and right relative to the base 3, so that the user can experience the actual feeling of riding a bike to enhance the fun during the exercise.

For the safety during the exercise, the base 3 is provided with elastic members 33 at both sides of the pivot portion 32 as a cushion. When the bike body swings left and right, it is pressed against the elastic member 33 on the corresponding side to obtain the cushioning resistance, so as to prevent the user from falling and being injured. In the above-mentioned conventional structure, the elastic member 33 is disposed in an upright manner. When it is pressed, a deformation in the height direction is generated to provide a cushioning resistance in the height direction. But, the swinging motion of the bike body 31 is performed along a curved trajectory. It is difficult for the upright elastic member 33 to stably support the swinging bike body 31, with safety concerns. Accordingly, the inventor of the present invention has devoted himself based on his many years of practical experiences to solve these problems.

SUMMARY OF THE INVENTION

The primary object of the present invention is to provide a swingable exercise bike, which is used to cushion the swinging bike body to provide horizontal support, thereby ensuring that the bike body obtains stable support to prevent the user from falling and being injured.

In order to achieve the aforesaid object, a swingable exercise bike is provided. The swingable exercise bike comprises a base and two cushion devices. The base has a pivot portion for a bike body to be pivotally connected to the pivot portion so that the bike body is able to swing left and right relative to the base. The two cushion devices are disposed on the base and located at left and right sides of the pivot portion. Each of the cushion devices is connected to the bike body for providing a cushioning resistance in a horizontal direction when the bike body swings left and right.

In an embodiment, each of the cushion devices includes a rail groove extending in the horizontal direction. The rail groove has a first end adjacent to the pivot portion and a second end away from the pivot portion. A slider is provided between the first end and the second end. A first elastic member is provided between the slider and the second end. A connecting rod is connected between the slider and the bike body. Two ends of the connecting rod are pivotally connected to the slider and the bike body, respectively. When the bike body swings left and right, the bike body pushes the slider in the rail groove through the connecting rod to press the first elastic member to obtain the cushioning resistance.

Preferably, in the swingable exercise bike, a second elastic member is provided between the slider and the first end. The second elastic member cooperates with the first elastic member to provide the cushioning resistance when the bike body swings left and right.

Preferably, the first elastic member and the second elastic member are springs.

In an embodiment, the two cushion devices extending toward left and right sides of the bike body.

DETAILED DESCRIPTION OF THE PREFERRED EMBODIMENTS

Embodiments of the present invention will now be described, by way of example only, with reference to the accompanying drawings.

Figure 1:
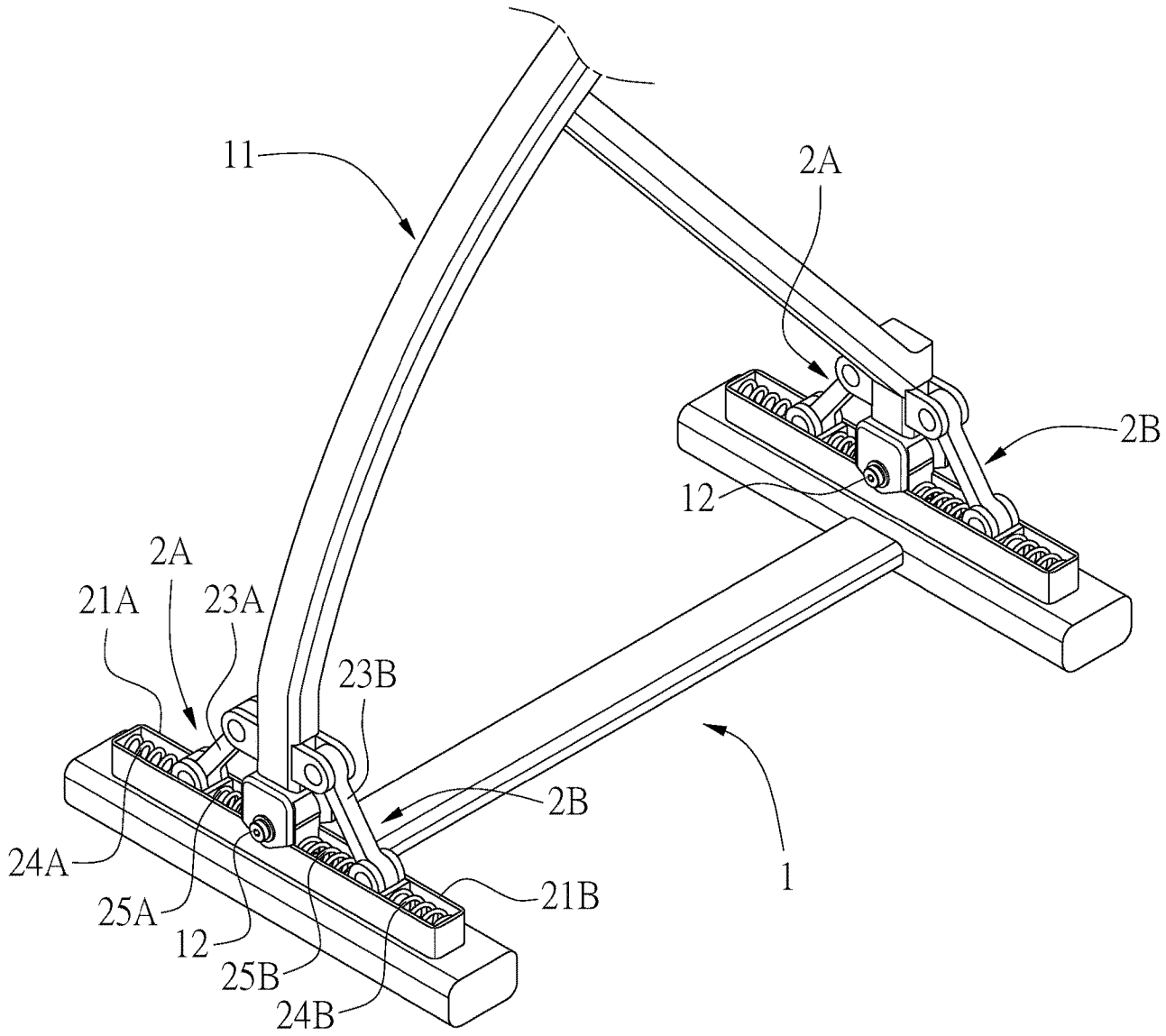
FIG. 1 is a perspective view of the present invention.
Figure 2:
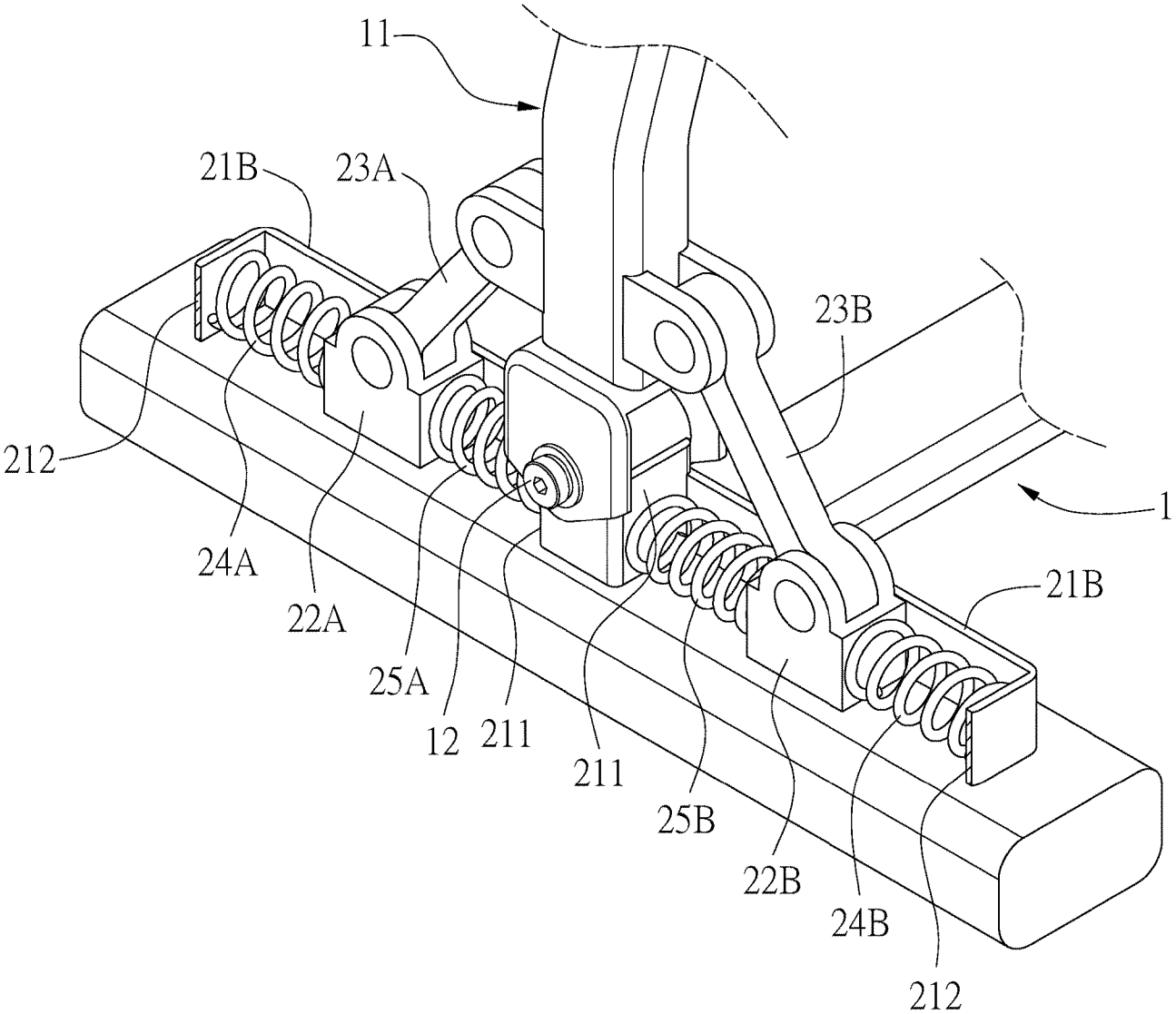
FIG. 2 is a partially enlarged view of the present invention.

Referring to FIG. 1 and FIG. 2, the present invention discloses a swingable exercise bike, comprising a bike body 11 and a base 1. The bike body 11 is a flywheel structure of any type in the prior art. The bike body 11 comprises a frame, a seat, an armrest, a rotating wheel, a pedal, and a resistance wheel (not shown). The front and rear ends of the base 1 are provided with pivot portions 12, respectively. The bike body 11 is pivotally connected to the pivot portions 12, so that the bike body 11 is able to swing left and right relative to the base 1.

The base 1 is provided with cushion devices 2A, 2B located at the left and right sides of the pivot portions 12 for providing a cushioning resistance when the bike body 11 swings left and right. As shown in FIG. 2, the cushion devices 2A, 2B include rail grooves 21A, 21B. The rail grooves 21A, 21B extend in the horizontal direction. In this embodiment, the rail groove 21A located at the left side of the pivot portion 12 extends along the left side, and the rail groove 21B at the right side of the pivot portion 12 extends along the right side.

The rail grooves 21A, 21B each have a first end 211 adjacent to the pivot portion 12 and a second end 212 away from the pivot portion 12. A slider 22A, 22B is provided between the first end 211 and the second end 212. The slider 22A, 22B is connected to the bike body 11 through a connecting rod 23A, 23B. One end of the connecting rod 23A, 23B is pivotally connected to the slider 22A, 22B, and another end of the connecting rod 23A, 23B is pivotally connected to the bike body 11. When the bike body 11 swings left and right, the bike body 11 pushes the connecting rod 23A, 23B and the connecting rod 23A, 23B pushes the slider 22A, 22B, so that the slider 22A, 22B can slide left and right between the first end 211 and the second end 212 of the rail groove 21A, 21B.

In the rail groove 21A, 21B, a first elastic member 24A, 24B is provided between the slider 22A, 22B and the second end 212, and a second elastic member 25A, 25B is provided between the slider 22A, 22B and the first end 211. The first elastic member 24A, 24B and the second elastic member 25A, 25B are deformable in the horizontal direction by the force in the horizontal direction to form an elastic return force in the horizontal direction, thereby serving as the cushioning resistance. In this embodiment, the first elastic member 24A, 24B and the second elastic member 25A, 25B are springs disposed in the horizontal direction and can be compressed or extended in the horizontal direction under stress.

Figure 3:
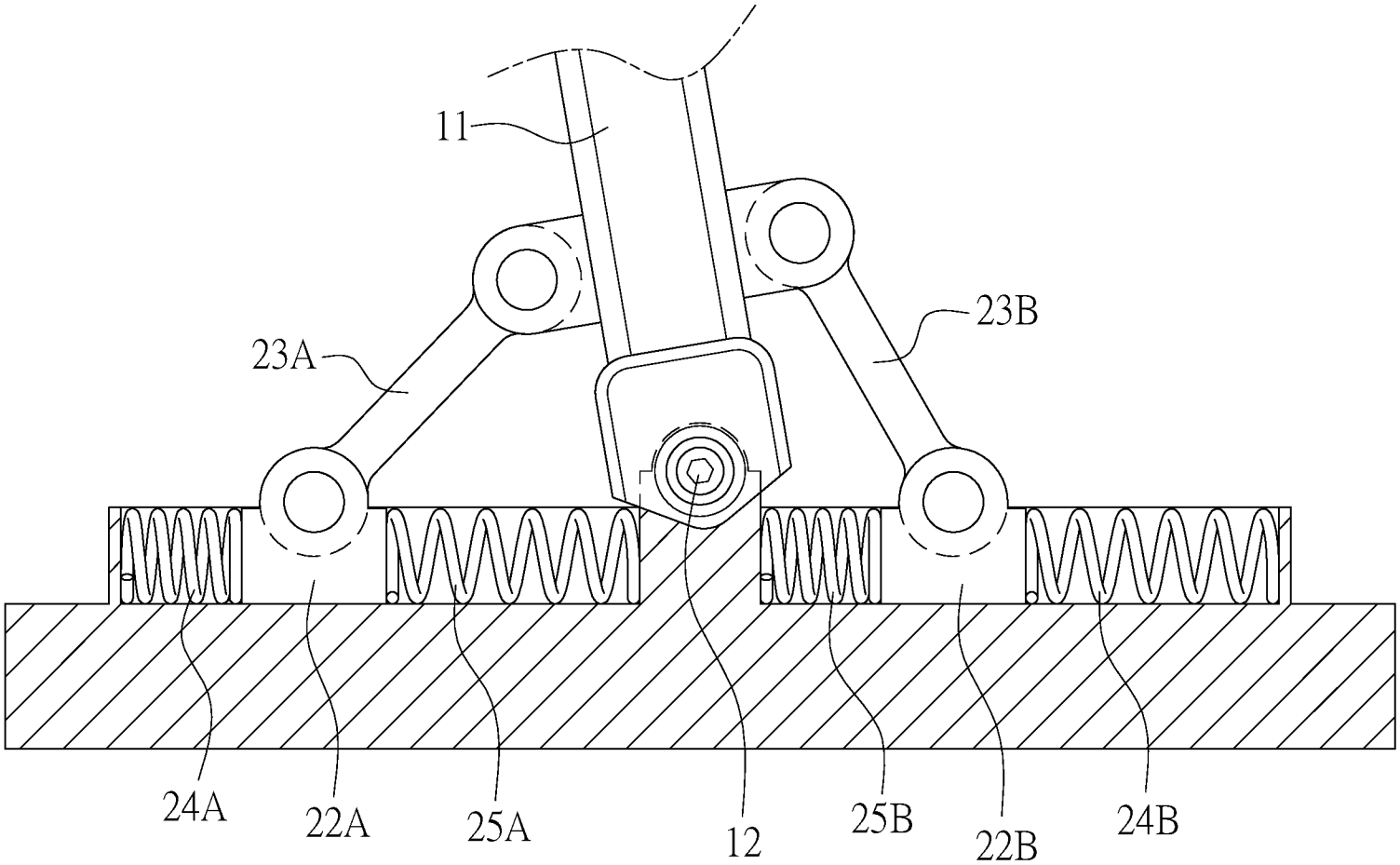
FIG. 3 and FIG. 4 are schematic views of the present invention when in use.

With the above configuration, when the user swings the bike body 11 left, as shown in FIG. 3, the bike body 11 pushes the left connecting rod 23A which in turn pushes the left slider 22A to move left. The slider 22A compresses the first elastic member 24A at the left side to generate an elastic return force toward the right side, whereby the bike body 11 can obtain the cushioning resistance and is more stable when swinging to the left side. The slider 22A simultaneously extends the second elastic member 25A at the left side to generate an elastic return force toward the right ride, thereby cooperating with the first elastic member 24A to provide the cushioning resistance when the bike body 11 swings to the left side. On the other hand, the bike body 11 swinging to the left side simultaneously pulls the right slider 22B to move left through the connecting rod 23B at the right side. The slider 22B compresses the second elastic member 25B at the right side to generate an elastic return force toward the right side, whereby the bike body 11 can obtain the cushioning resistance and is more stable when swinging to the left side. The slider 22B simultaneously extends the first elastic member 24B at the right side to generate an elastic return force toward the right ride, thereby cooperating with the second elastic member 25B to provide the cushioning resistance when the bike body 11 swings to the left side.

Figure 4:
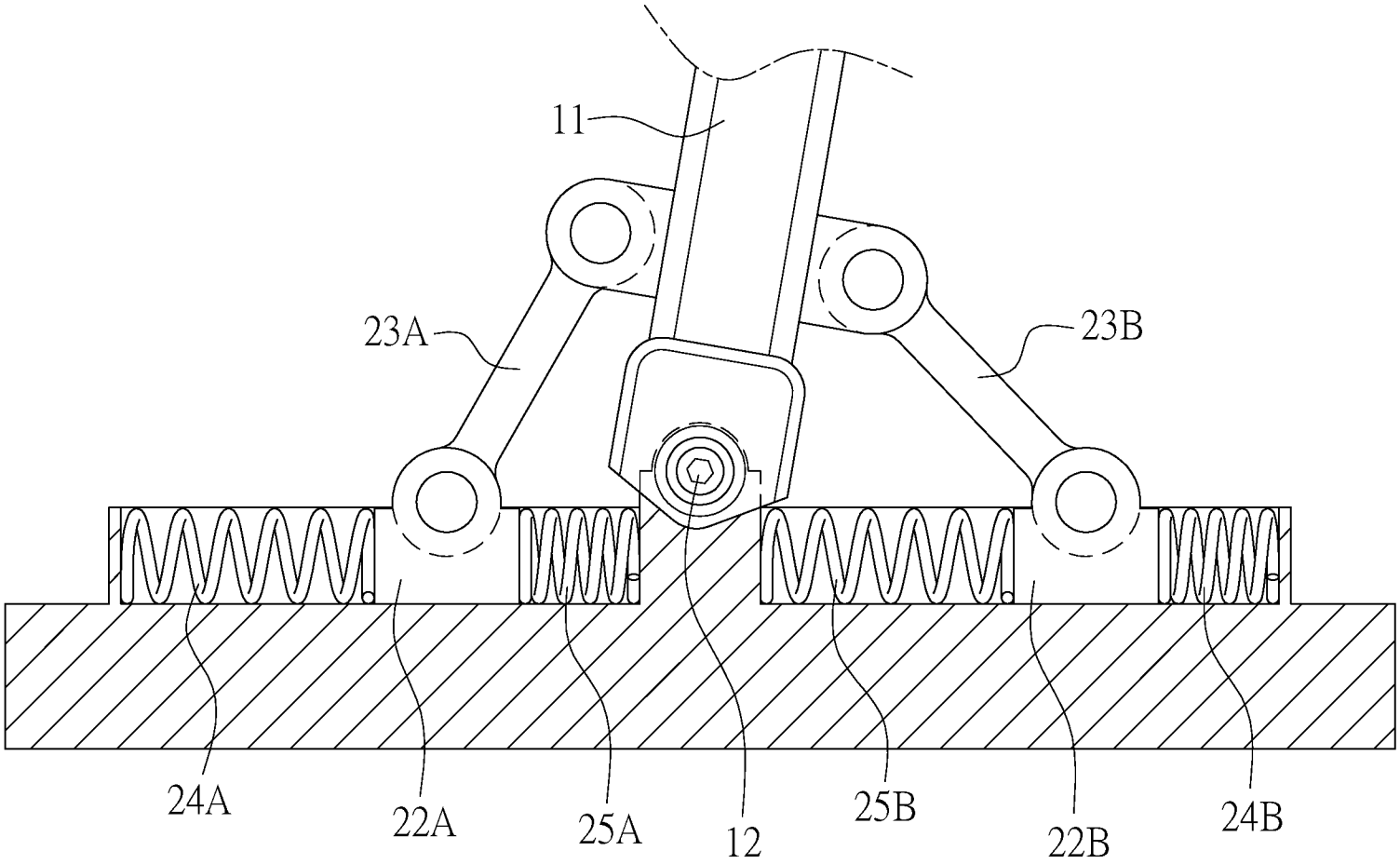
Figure 5:
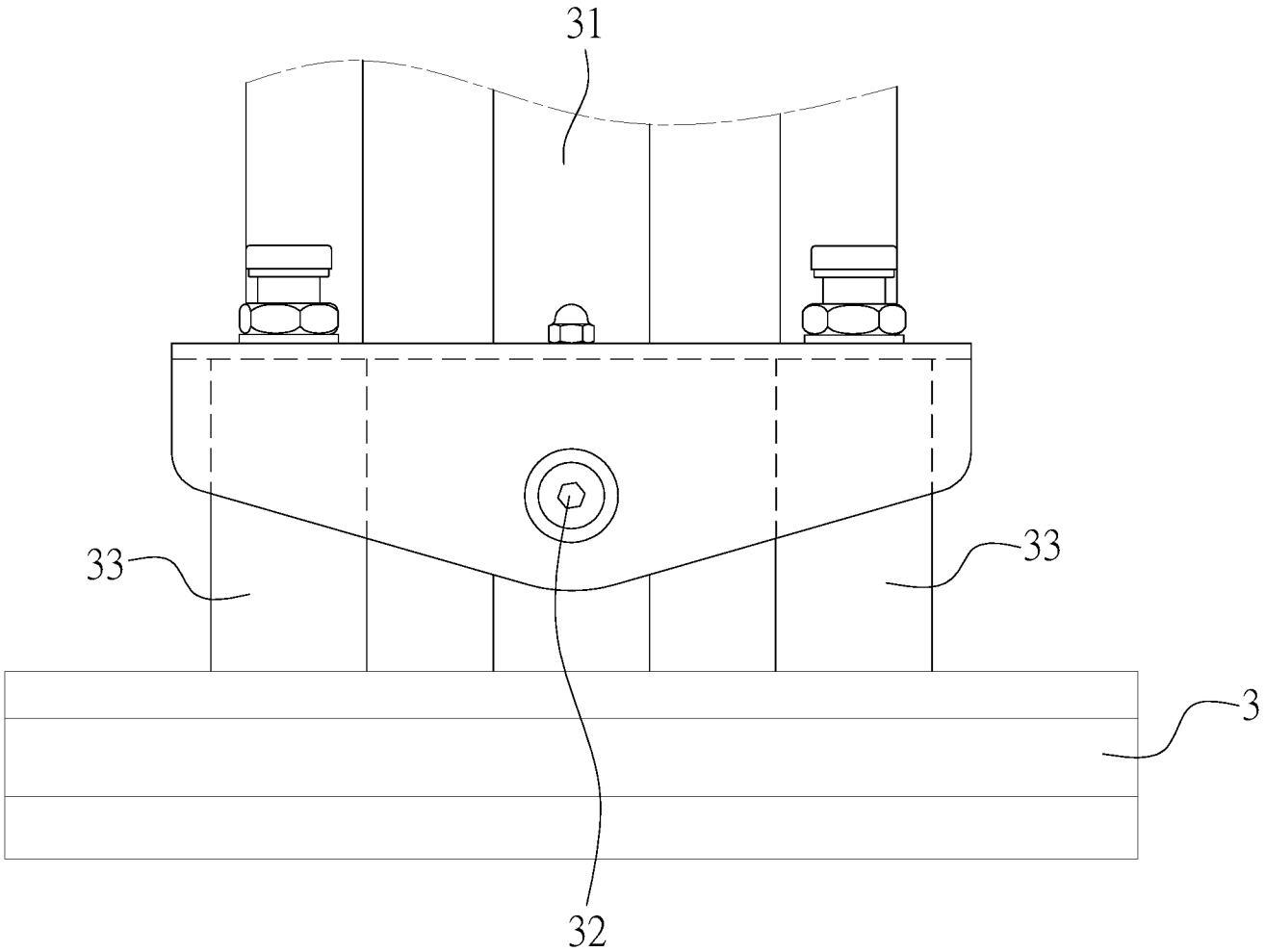
FIG. 5 PRIOR ART
FIG. 5 a planar view of the prior art.

When the user swings the bike body 11 right, as shown in FIG. 4, the bike body 11 pushes the right connecting rod 23B which in turn pushes the right slider 22B to move right. The slider 22B compresses the first elastic member 24B at the right side to generate an elastic return force toward the left side, whereby the bike body 11 can obtain the cushioning resistance and is more stable when swinging to the right side. The slider 22B simultaneously extends the second elastic member 25B at the right side to generate an elastic return force toward the left ride, thereby cooperating with the first elastic member 24B to provide the cushioning resistance when the bike body 11 swings to the right side. On the other hand, the bike body 11 swinging to the right side simultaneously pulls the left slider 22A to move right through the connecting rod 23A at the left side. The slider 22A compresses the second elastic member 25A at the left side to generate an elastic return force toward the left side, whereby the bike body 11 can obtain the cushioning resistance and is more stable when swinging to the right side. The slider 22A simultaneously extends the first elastic member 24A at the left side to generate an elastic return force toward the left ride, thereby cooperating with the second elastic member 25A to provide the cushioning resistance when the bike body 11 swings to the right side.

Through the foregoing description, it can be understood that the present invention provides the horizontal elastic return force as the support through the first elastic members 24A, 24B and the second elastic members 25A, 25B. Thereby, when the bike body 11 swings left and right, it is ensured that the bike body 11 obtains stable support, thereby achieving the effect of preventing the user from falling and being injured to improve the safety in use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A swingable exercise bike, comprising:

a base having a pivot portion to be pivotally connected to a bike body so that the bike body is able to swing left and right relative to the base;

two cushion devices disposed on the base and located at left and right sides of the pivot portion, wherein each of the cushion devices includes a rail groove extending in the horizontal direction, the rail groove has a first end adjacent to the pivot portion and a second end away from the pivot portion, a slider is provided between the first end and the second end, a first elastic member is provided between the slider and the second end; two ends of a connecting rod are pivotally connected to the slider and the bike body respectively, when the bike body swings left and right, the bike body pushes the slider in the rail groove through the connecting rod to press the first elastic member to obtain the cushioning resistance;

wherein each of the cushion devices are connected to the bike body for providing a cushioning resistance.

2. The swingable exercise bike as claimed in claim 1, wherein the first elastic member is a spring.

3. The swingable exercise bike as claimed in claim 1, wherein a second elastic member is provided between the slider and the first end, and the second elastic member cooperates with the first elastic member to provide the cushioning resistance when the bike body swings left and right.

4. The swingable exercise bike as claimed in claim 3, wherein the second elastic member is a spring.

5. The swingable exercise bike as claimed in claim 1, wherein the rail grooves of the two cushion devices extending toward left and right sides of the bike body.

* * * * *